US006664847B1

(12) United States Patent
Ye

(10) Patent No.: US 6,664,847 B1
(45) Date of Patent: Dec. 16, 2003

(54) CTAT GENERATOR USING PARASITIC PNP DEVICE IN DEEP SUB-MICRON CMOS PROCESS

(75) Inventor: Jing Ye, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/268,174

(22) Filed: Oct. 10, 2002

(51) Int. Cl.[7] ..... G05F 1/10

(52) U.S. Cl. ..... 327/543; 327/539; 327/543; 323/315

(58) Field of Search ..... 327/538, 539, 327/540, 541, 543, 542; 323/312, 315

(56) References Cited

U.S. PATENT DOCUMENTS

| | | | | | |
|---|---|---|---|---|---|
| 4,472,675 | A | * | 9/1984 | Shinomiya | 323/314 |
| 4,603,291 | A | | 7/1986 | Nelson | 323/315 |
| 5,034,626 | A | * | 7/1991 | Pirez et al. | 327/542 |
| 5,430,395 | A | * | 7/1995 | Ichimaru | 327/312 |
| 5,604,427 | A | * | 2/1997 | Kimura | 323/313 |
| 5,631,600 | A | * | 5/1997 | Akioka et al. | 327/543 |
| 5,744,999 | A | * | 4/1998 | Kim et al. | 327/543 |
| 5,818,294 | A | * | 10/1998 | Ashmore, Jr. | 327/543 |
| 5,990,727 | A | * | 11/1999 | Kimura | 327/513 |
| 6,016,051 | A | | 1/2000 | Can | 323/315 |
| 6,225,856 | B1 | | 5/2001 | Toth | 327/539 |
| 6,307,426 | B1 | | 10/2001 | Ricotti et al. | 327/543 |
| 6,310,519 | B1 | | 10/2001 | Ross | 330/289 |
| 6,346,848 | B1 | * | 2/2002 | Shkap | 327/538 |
| 6,366,071 | B1 | | 4/2002 | Yu | 323/316 |
| 6,373,330 | B1 | | 4/2002 | Holloway | 327/539 |
| 6,407,622 | B1 | | 6/2002 | Opris | 327/539 |
| 6,426,669 | B1 | | 7/2002 | Friedman et al. | 327/539 |
| 6,496,057 | B2 | * | 12/2002 | Wada et al. | 327/543 |
| 6,507,238 | B1 | * | 1/2003 | Yang | 327/540 |
| 6,522,117 | B1 | * | 2/2003 | Young et al. | 323/315 |

* cited by examiner

*Primary Examiner*—Terry D. Cunningham
(74) *Attorney, Agent, or Firm*—April M. Mosby; Wade James Brady, III; Frederick J. Telecky, Jr.

(57) ABSTRACT

A control circuit generates a current that remains substantially constant over temperature using a bandgap reference for providing a PTAT current. A first current mirror generates a current proportional to the PTAT current. A novel complementary to absolute temperature (CTAT) current source provides a CTAT current void of bipolar transistor base current, regardless of whether it is implemented in a CMOS digital process or not. It includes a first bias current source that connects to a first resistive circuit and a first subcircuit portion. The first subcircuit portion, including a first bipolar transistor, generates a current proportional to the base emitter voltage of the first bipolar transistor and the base current of the first bipolar transistor. A second bias current source connects to a second resistive circuit and a second subcircuit portion. The second subcircuit portion, including a second bipolar transistor, generates a current proportional to the base current of the second bipolar transistor. A second current mirror connects between the first subcircuit portion and the second subcircuit portion to subtract the base current of the first bipolar transistor and, thus, provide a CTAT current proportional to the first and second resistive circuits. A third current mirror connects between the second current mirror and the first current mirror such that the PTAT current and the CTAT current are summed together to provide current that remains substantially constant over temperature.

10 Claims, 2 Drawing Sheets

CTAT GENERATOR USING PARASITIC PNP DEVICE IN DEEP SUB-MICRON CMOS PROCESS

FIELD OF THE INVENTION

The present invention relates to an integrated circuit, and, more particularly, to a low voltage bandgap reference manufactured using a deep sub-micron CMOS process having a current complementary to absolute temperature sub-circuit coupled to provide a current substantially constant over temperature.

BACKGROUND OF THE INVENTION

Various systems, such as analog-to-digital converters (ADC), digital-to-analog converters (DAC), temperature sensors, measurement systems and voltage regulators use bandgap reference circuits to establish the accuracy of the system. Bandgap reference circuits provide local reference voltages of a known value that remains stable with both temperature and process variations. As such, the bandgap reference circuit provides a stable, precise, and continuous output reference voltage for use in various analog circuits. A known bandgap reference circuit derives its reference voltage by compensating the base-emitter voltage of a bipolar transistor $V_{BE}$ for its temperature dependence (which is inversely proportional to temperature) using a proportional to absolute temperature (PTAT) voltage. With reference to FIG. 2, the difference between the base-emitter voltages, $V_{BE1}$ and $V_{BE2}$ or $\Delta V_{BE}$, of two transistors that are operated at a constant ratio between their emitter-current densities forms the PTAT voltage.

The emitter-current density is conventionally defined as the ratio of the collector current to the emitter size. Thus, the basic PTAT voltage $\Delta V_{BE}$ is given by:

$$\Delta V_{BE}=V_{BE1}-V_{BE2} \quad (1)$$

$$\Delta V_{BE}=(kT/q)In(J_1/J_2) \quad (2)$$

where k is the Boltzmann's constant, T is the absolute temperature in degree Kelvin, q is the electron charge, $J_1$ is the current density of a transistor $T_1$, and $J_2$ is the current density of a transistor $T_2$. As a result, when two silicon junctions are operated at different current densities, $J_1$ and $J_2$, the differential voltage $\Delta V_{BE}$ is a predictable, accurate and linear function of temperature. Consequently, the output current $I_{out2}$ is proportional to absolute temperature since $I_{out2}=\Delta V_{BE}/R_2$. In some applications, however, to better control power consumption, a current substantially independent of temperature is desirable.

In an effort to provide a reference voltage and current that is constant and substantially independent of temperature, a current source that provides a current complementary to absolute temperature (CTAT) is necessary, wherein the PTAT current from the bandgap reference circuit shown in FIG. 2 and the CTAT current are combined. A temperature independent reference current is provided when the PTAT current, that increases with temperature, and the CTAT current, that decreases with temperature are summed together. If the two slopes of both currents, PTAT and CTAT, are equal in magnitude but opposite in sign, the sum will be independent of temperature. This constant current is applied to a resistor to create a constant voltage.

Conventionally, a CTAT current is provided using current that is proportional to the base-emitter voltage of a bipolar transistor $V_{BE}$ for its temperature dependence which is inversely proportional to temperature. The current source shown in FIG. 1 follows this approach. In processes where the gain β of the bipolar device $Q_1$ is greater than 50, the base current of the bipolar device is ignored. Thus, the output current $I_{out1}$ equals $V_{BE}/R_1$, where $V_{BE}$ is the base emitter voltage of bipolar device $Q_1$. Since the base emitter voltage $V_{BE}$ includes a negative temperature coefficient, the output current $I_{out1}$ represents a CTAT current. In a CMOS digital process such as Texas Instrument's ® 1833c05 process, however, the gain β of bipolar device $Q_1$. is less than 10. As such, the base current $I_B$ of the bipolar device $Q_1$. cannot be ignored. Thereby, the total output current $I_{out1}$ equals the sum $[(V_{BE}/R)+I_B]$. Thus, the conventional CTAT current source will not provide a CTAT current in a CMOS digital process.

Another approach that provides a current that is temperature independent may include an external resistor to set a temperature independent bias current. Although the external resistor has an adjustable value, most preferred implementations require that all the components be included on the chip.

Another popular approach is to apply a temperature independent reference voltage $V_{ref}$ to a resistor to generate a temperature independent current. Since the resistor's temperature coefficient cannot be compensated, the output current becomes temperature dependent. This design, however requires an additional buffer stage.

Thus, a need exists for a current source that provides a CTAT current void of bipolar transistor base current, regardless of whether it is implemented in a CMOS digital process or not. This current source must not be a complex circuit requiring an additional buffer stage.

SUMMARY OF THE INVENTION

To address the above-discussed deficiencies of current sources that provide CTAT current, the present invention teaches a current source that provides a current CTAT void of bipolar transistor base current, regardless of whether it is implemented in a CMOS digital process or not. This current source does not require an additional buffer stage.

A control circuit according to the present invention includes a bandgap reference for providing a PTAT current connected a first current mirror to generate a current proportional to the PTAT current. A novel complementary to absolute temperature (CTAT) current source in accordance with the present invention connects to the first current mirror such that the current proportional to the PTAT current and the CTAT current are summed together to provide the current that remains substantially constant over temperature.

This CTAT current source includes a first bias current source which connects to a first resistive circuit and a first subcircuit portion. The first subcircuit portion, including a first bipolar transistor, generates a current proportional to the base emitter voltage of the first bipolar transistor and the base current of the first bipolar transistor. A second bias current source connects to a second resistive circuit and a second subcircuit portion. The second subcircuit portion, including a second bipolar transistor, generates a current proportional to the base current of the second bipolar transistor. A second current mirror connects between the first subcircuit portion and the second subcircuit portion to subtract the base current from the first subcircuit portion. A third current mirror connects between the second current mirror and the first current mirror to provide the current that remains substantially constant over temperature.

These and other features and advantages of the present invention will be understood upon consideration of the following detailed description of the invention and the accompanying drawings.

BRIEF DESCRIPTION OF THE DRAWINGS

For a more complete understanding of the present invention and the advantages thereof, reference is now made to the following description taken in conjunction with the accompanying drawing in which like reference numbers indicate like features and wherein.

DETAILED DESCRIPTION OF PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set for the herein. Rather, these embodiments are provided so that this disclosure will be thorough and complete, and will fully convey the scope of the invention to those skilled in the art.

Figure 3:
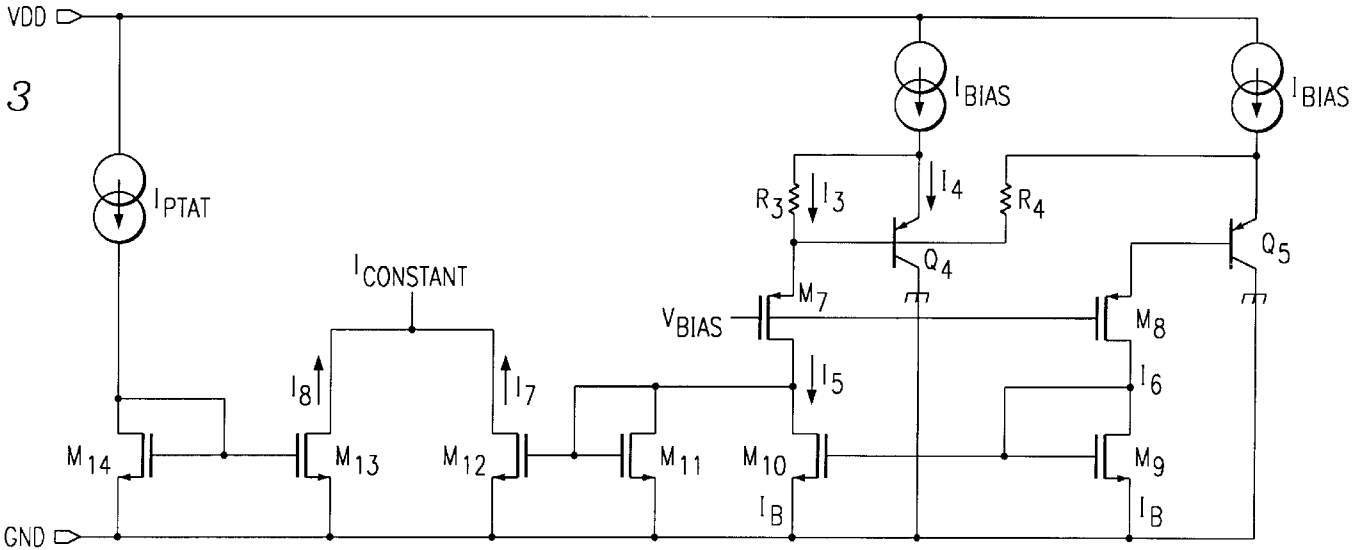
FIG. 3 shows a control circuit in accordance with the present invention.

FIG. 3 illustrates the schematic of the control circuit in accordance with the present invention that produces a current substantially constant over temperature. The IPAT current source couples to a first current mirror including transistors $M_{14}$ and $M_{13}$ to generate a current $I_8$ that is proportional to the PTAT current.

Figure 1:
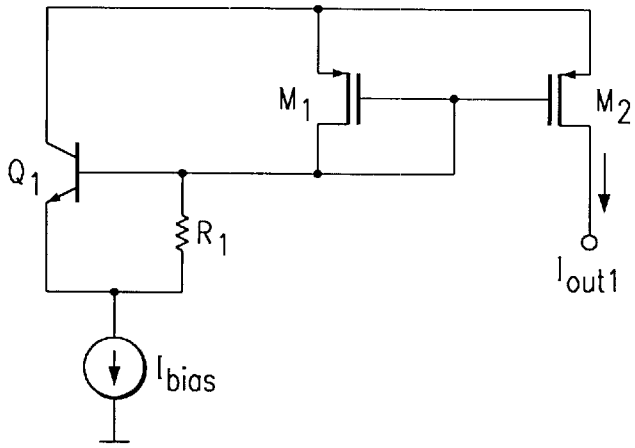
FIG. 1 illustrates a known CTAT current source.
Figure 2:
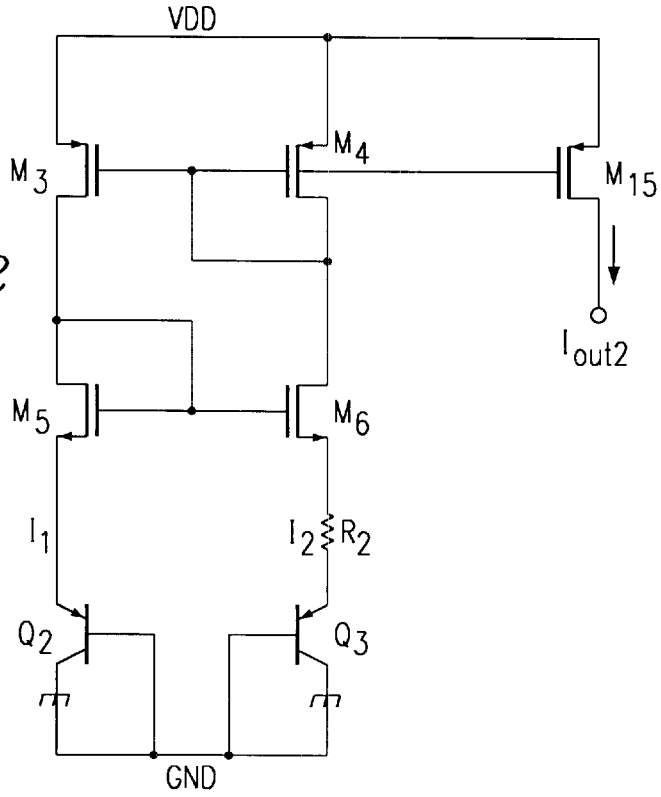
FIG. 2 displays a known PTAT current generator.

FIG. 2 illustrates an embodiment of a known PTAT current source that may be incorporated into the control circuit of FIG. 3. In this particular implementation, the base-emitter area of transistor $Q_3$ is made eight times as large as that of transistor $Q_2$. Thus, currents, $I_1$ and $I_2$, equations are as follows:

$$I_1 = I_S \exp\left(\frac{V_{BE1}}{V_T}\right)$$

$$I_2 = 8I_S \exp\left(\frac{V_{BE2}}{V_T}\right)$$

$$I_2 R_2 = V_{BE1} - V_{BE2} = V_T \ln 8$$

The current mirror formed by transistors, $M_3$ and $M_4$, set currents $I_1$ and $I_2$ equal to one another, such that the currents are equal as follows:

$$I_1 = I_2 = \frac{V_{BE1} - V_{BE2}}{R_2} = \frac{V_T \ln 8}{R_2}$$

The temperature coefficient of $R_2$ can be ignored. Thus, current $I_2$ is a current proportional to absolute temperature (PTAT). With reference to FIG. 3, current $I_2$ is fed into the first current mirror including transistors $M_{14}$ and $M_{13}$ to generate a current $I_8$ that is proportional to the PTAT current $I_2$.

With further reference to FIG. 3, the value of resistors, $R_3$ and $R_4$, and the size of transistors $M_7$ and $M_8$ are set equal such that currents, $I_3$ and $I_4$, across the base and emitter of transistors $Q_4$ and $Q_5$ are equal, as follows:

$$I_R = I_3 = I_4 = V_{BE}/R_3$$

From the above equation, currents, $I_3$ and $I_4$, are proportional to the base-emitter voltage $V_{BE}$ for transistors, $Q_4$ and $Q_5$, which includes a negative temperature coefficient.

In a CMOS digital process such as Texas Instrument's ® 1833c05 process, the gain $\alpha$ of each bipolar device, $Q_4$ and $Q_5$, is less than 10. As such, the base current $I_B$ of each bipolar device, $Q_4$ and $Q_5$, cannot be ignored as compared to the collector current $I_C$ for each bipolar device, $Q_4$ and $Q_5$. Thereby, the total current across transistor $M_7$ equals the sum $[2(V_{BE}/R)+I_B]$. This current is not exactly a CTAT current. Thus, the use of the extra transistors of $M_7$–$M_{12}$ are necessary to extract a true CTAT current.

The current through transistor $M_8$ equals the base current $I_B$ of transistor $Q_5$. The base current $I_B$ of transistor $Q_4$ equals the base current $I_B$ of $Q_5$. The current through transistor $M_7$ equals to $(2I_R+I_B)$. By using the current mirror including the transistor pair, $M_9$ and $M_{10}$, the base current $I_B$ is cancelled out from the current that flows through transistor $M_7$. The third current mirror including transistor pair, $M_{11}$ and $M_{12}$, is connected to the second current mirror including the transistor pair, $M_9$ and $M_{10}$, such that current of only $2I_R$ flows to transistor $M_{12}$ to be added with the PTAT current $I_8$ to provide a current $I_{constant}$ substantially constant over temperature, wherein:

$$I_{constant} = kI_{PTAT} + (2V_{BE}/R)$$

In spite of the temperature-dependent resistors, $R_2$, $R_3$ and $R_4$, the value of k can always be adjusted such that current $I_{constant}$ remains substantially constant over temperature, as long as k is linear.

Figure 4:
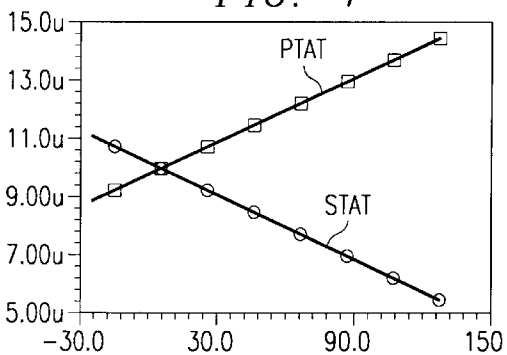
FIG. 4 illustrates the PTAT and CTAT currents with respect to temperature.

FIG. 4 shows the CTAT current from the control circuit of FIG. 3 along with the PTAT current from the known bandgap reference of FIG. 2. As shown, the PTAT current increases with temperature and the CTAT current decreases with temperature.

Figure 5:
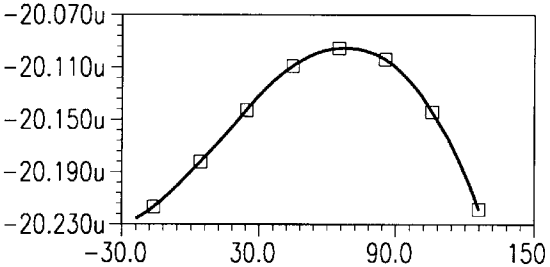
FIG. 5 shows the current that remains substantially constant over temperature as provided from the circuit of FIG. 3.

FIG. 5 displays the current that remains substantially constant over temperature which is the sum of the CTAT current and PTAT current. There is minimal curvature of approximately −0.20 $\mu$amps which those skilled in the art can recognize may be eliminated using known curvature correction circuits.

Those of skill in the art will also recognize that the physical location of the elements illustrated in FIG. 3 can be moved or relocated while retaining the function described above.

The reader's attention is directed to all papers and documents which are filed concurrently with this specification and which are open to public inspection with this specification, and the contents of all such papers and documents are incorporated herein by reference.

All the features disclosed in this specification (including any accompany claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A control circuit for generating a current that remains substantially constant over temperature, comprising:

a proportional to absolute temperature (PTAT) current source that provides a PTAT current;

a first current mirror coupled to receive the PTAT current to generate a current proportional to the PTAT current;

a complementary to absolute temperature (CTAT) current source that provides a CTAT current, the CTAT current source coupled to the first current mirror to form an output node such that the current proportional to the PTAT current and the CTAT current are summed together to provide the current that remains substantially constant over temperature at the output node; and wherein the CTAT current source comprises, a first bias current source, a first resistive circuit coupled to receive the first bias current, a first subcircuit portion coupled to the first resistive circuit and the first bias current source, the first subcircuit portion, having a first bipolar transistor, coupled to receive the first bias current to generate a current proportional to the base emitter voltage of the first bipolar transistor and the base current of the first bipolar transistor, a second bias current source, a second resistive circuit coupled to receive the second bias current, a second subcircuit portion coupled to the second resistive circuit and the second bias current source, second subcircuit portion, having a second bipolar transistor, coupled to receive the second bias current to generate a current proportional to the base current of the second bipolar transistor, a second current mirror coupled between the first subcircuit portion and the second subcircuit portion to subtract the base current from the first subcircuit, and a third current mirror coupled between the second current mirror and the first current mirror to provide the current that remains substantially constant over temperature.

2. A control circuit as recited in claim 1, wherein the PTAT current source is a bandgap reference circuit.

3. A control circuit as recited in claim 1, wherein the first current mirror comprises:

a first FET transistor, having a gate, a drain and a source, the drain and the gate coupled to receive the PTAT current, the source coupled to ground; and a second FET transistor, having a gate, a drain and a source, the gate coupled to the gate of the first FET transistor, the source coupled to ground, the drain coupled to the output node to provide the current proportional to the PTAT current.

4. A control circuit as recited in claim 1, wherein the first subcircuit portion comprises:

a first bipolar transistor, having a base, a collector, and an emitter, the emitter coupled to receive the first bias current, the collector coupled to ground, the first resistive circuit coupled between the emitter and base of the first bipolar transistor; and a first FET transistor having a gate, a drain, and a source, the source coupled to the base of the first bipolar transistor, the gate coupled to receive the bias voltage, the drain coupled to the second current source.

5. A control circuit as recited in claim 4, wherein the first resistive circuit is a resistor.

6. A control circuit as recited in claim 1, wherein the second subcircuit portion comprises:

a second bipolar transistor, having a base, a collector, and an emitter, the emitter coupled to receive the second bias current, the collector coupled to ground, the second resistive circuit coupled between the emitter of the second bipolar transistor and base of the first bipolar transistor; and a second FET transistor having a gate, a drain, and a source, the source coupled to the base of the second bipolar transistor, the gate coupled to receive the bias voltage, the drain coupled to the second current mirror.

7. A control circuit as recited in claim 6, wherein the second resistive circuit is a resistor.

8. A control circuit as recited in claim 1, wherein the second current mirror comprises:

a first FET transistor, having a gate, a drain and a source, the drain and the gate coupled to the second subcircuit portion, the source coupled to ground; and a second FET transistor, having a gate, a drain and a source, the drain coupled to the first subcircuit portion, the gate coupled to the gate of the first FET transistor, the source coupled to ground.

9. A control circuit as recited in claim 1, wherein the third current mirror comprises:

a first FET transistor, having a gate, a drain and a source, the drain and the gate coupled to the first subcircuit portion, the source coupled to ground; and a second FET transistor, having a gate, a drain and a source, the drain coupled to the output node, the gate coupled to the gate of the first FET transistor, the source coupled to ground.

10. A method of generating a current that remains substantially constant over temperature from a bandgap reference voltage, comprising the steps of:

a. providing a proportional to absolute temperature (PTAT) current;

b. receiving the PTAT current by a first current mirror to provide a current proportional to the PTAT current;

c. providing a first bias current;

d. receiving the first bias current by a first transistor having a base, an emitter and a collector, the emitter coupled to receive the first bias current, the collector coupled to ground, and in accordance therewith providing a first base-emitter voltage and a first base current;

e. receiving the first bias current by a first resistive circuit coupled between the base and emitter of the first transistor and in accordance therewith providing a current proportional to the base-emitter voltage of the first transistor;

f. providing a second bias current;

g. receiving the second bias current by a second transistor having a base, an emitter and a collector, the emitter coupled to receive the second bias current, the collector coupled to ground, and in accordance therewith providing a second base-emitter voltage and a second base current;

h. receiving the second bias current by a second resistive circuit coupled between the emitter of the second transistor and the base of the first transistor and in accordance therewith providing a current proportional to the base-emitter voltage of the second transistor, the current provided by the first resistive circuit equals the current provided by the second resistive circuit;

i. providing a bias voltage;

j. receiving the bias voltage by a third and fourth transistor having a gate, a drain, and a source, the gate of the third and fourth transistor coupled to receive the bias voltage, the source of the third transistor coupled to the base of the first transistor, the source of the fourth transistor coupled to the base of the second transistor;

k. receiving the current provided by to the first and second resistive circuit and first and second base current by a second current mirror, the first and second base current are equal and oppose such that the second base current eliminates the first base current, and in accordance therewith providing a current complementary to absolute temperature (CTAT);

l. adjusting the first current mirror such that the slope with respect to temperature of the PTAT current is equal in magnitude and opposite in sign to the slope with respect to temperature of the CTAT current; and m. combining the PTAT and CTAT currents using a third current mirror coupled between the first and the second current mirrors to provide a current that remains substantially constant over temperature.

* * * * *